US005302330A

United States Patent [19]

Umansky et al.

[11] Patent Number: 5,302,330

[45] Date of Patent: Apr. 12, 1994

[54] METHOD FOR THE MANUFACTURE OF WAFERBOARD

[76] Inventors: Harold Umansky, 701 Sheridan Ave., Plainfield, N.J. 07060; Robert J. Coakley, 114 Makatom Dr., Cranford, N.J. 07016

[21] Appl. No.: 73,032

[22] Filed: Jun. 8, 1993

[51] Int. Cl.[5] ..... D04H 1/00

[52] U.S. Cl. ..... 264/109

[58] Field of Search ..... 264/109, 338

[56] References Cited

U.S. PATENT DOCUMENTS

| | | | |
|---|---|---|---|
| 4,110,397 | 8/1978 | Wooler | 264/338 |
| 4,201,802 | 5/1980 | Vande Kieft | 264/109 |
| 4,257,995 | 3/1981 | McLaughlin et al. | 264/109 |
| 4,257,996 | 3/1981 | Farrissey, Jr. et al. | 264/109 |
| 4,258,169 | 3/1981 | Prather et al. | 264/109 |
| 4,374,791 | 2/1983 | Farrissey et al. | 264/109 |
| 4,376,088 | 3/1983 | Prather | 264/109 |
| 4,376,089 | 3/1983 | Bogner et al. | 264/109 |
| 4,428,897 | 1/1984 | Lowenkron et al. | 264/109 |
| 4,528,153 | 7/1985 | Scholl et al. | 264/109 |
| 4,528,154 | 7/1985 | Nguyen et al. | 264/109 |
| 4,532,096 | 7/1985 | Bogner et al. | 264/109 |
| 4,565,662 | 1/1986 | Mansson et al. | 264/109 |
| 4,940,741 | 7/1990 | De Wacker et al. | 264/109 |
| 5,209,886 | 5/1993 | Simons | 264/109 |

*Primary Examiner*—Mary Lynn Theisen

*Attorney, Agent, or Firm*—Ostrolenk, Faber, Gerb & Soffen

[57] ABSTRACT

A method for applying release agent to wood material and binder used in the manufacture of chipboard. An aqueous solution of the release agent is foamed to form a coherent foam blanket that is applied to the wood material and binder. The foam leaves a coating of release agent on the wood material and binder that enhances release of a platen from the same. Foaming the release agent avoids deleterious aerosolization and increases the efficiency of applying the release agent.

10 Claims, 2 Drawing Sheets 30
10

50
40
20
90
100
80
70
110
60
120
130
150
160

METHOD FOR THE MANUFACTURE OF WAFERBOARD

BACKGROUND OF THE INVENTION

1. Field of the Invention

The present invention relates to an improved method for the manufacture of the construction material known as "waferboard" or "chipboard" and, more particularly, an improved process for applying release agent to a mass of wood material and binder to facilitate release of the mass from a platen used to compress it during the manufacture of chipboard.

2. Description of the Related Art

Chipboard is a substitute for common plywood. It is manufactured by compressing "chips" or small broken-up pieces of wood material and binder into flat sheets suitable for use in construction. The chips may also be compressed into other shapes useful in construction and other applications. In the manufacture of chipboard, trees are "chipped" or mechanically broken-up into small pieces approximately 1–3 inches in length by ¼–1 inch in width by 1/32–1/16 inch in thickness. The chips are then mixed with a binder or glue, such as diphenyl methyl diisocyanurate (MDI). A specific volume of chips mixed with MDI is placed on a press where heated, top and bottom platens compress the mass into boards of various dimensions. Both platens are conventionally sprayed with a release agent which prevents the mass of chips and binder from adhering to the hot platens during the compression of the chips and binder. See for example U.S. Pat. Nos. 4,532,096 and 4,374,791.

Spraying the release agent upon the platen, however, is disadvantageous. Aerosolized release agents are sprayed into the atmosphere, thus increasing pollution and possible adverse effects on workers. Moreover, spraying the release agent is not an efficient mode of applying the agent. Significant amounts of the release agent are lost into areas other than the interface of the wafers and the platen.

Numerous other methods of applying release agent are also known. Release agent has been brushed onto the top surface of wood material and binder prior to the step of hot pressing (U.S. Pat. No. 4,201,802). It has been found that utilizing a metallic surface including magnesium and zinc for the platen enhances release of the wood material and binder therefrom (U.S. Pat. No. 4,428,897). Binders having a self-release effect (U.S. Pat. No. 4,528,153) or incorporating an internal release agent are also known (U.S. Pat. Nos. 4,528,153, 4,376,089, 4,528,154, 4,257,995, 4,257,996, 4,376,088 and 4,258,169). See also U.S. Pat. No. 4,110,397 which teaches providing a metallic soap at the interface between the mold and the mass of wood material and binder to assist release.

SUMMARY OF THE INVENTION

It is an object of the present invention to provide a new method for applying release agent to a mass of wood material and binder during the production of chipboard, the method avoiding the disadvantages associated with spraying the release agent on the mold, in particular, the aerosolizing of release agent.

Another object of the invention is to provide complete and uniform coverage of the wood material and binder with release agent while reducing the levels of release agent required.

These objectives, and other objectives, are achieved by the method of the present invention wherein an aqueous solution of release agent and foaming agent is pressurized and a predetermined amount of pressurized aqueous solution is metered to a foamer. The aqueous solution is foamed in the foamer, preferably using compressed air or a pump, to form a coherent, continuously uniform, finely bubbled foam containing the release agent. The foam is dispersed onto a mass of wood material and binder, leaving release agent on the mass to enhance release of the mass from the platen after hot compression of the mass.

The aqueous solution may be pressurized using a predetermined amount of compressed air or a pump. Preferably, a continuous blanket of the foam is dispersed on the mass by forming individual streams of the foam on the mass and merging the individual streams to form the continuous blanket.

The above summarized method may be utilized as part of a total method for manufacturing chipboard, including in addition to the above steps, the steps of compressing the mass and cutting the compressed mass into any desired shape and size to form the chipboard.

Other features and advantages of the present invention will become apparent from the following description of the invention which refers to the accompanying drawings.

DETAILED DESCRIPTION OF THE PREFERRED EMBODIMENT

Figure 1:
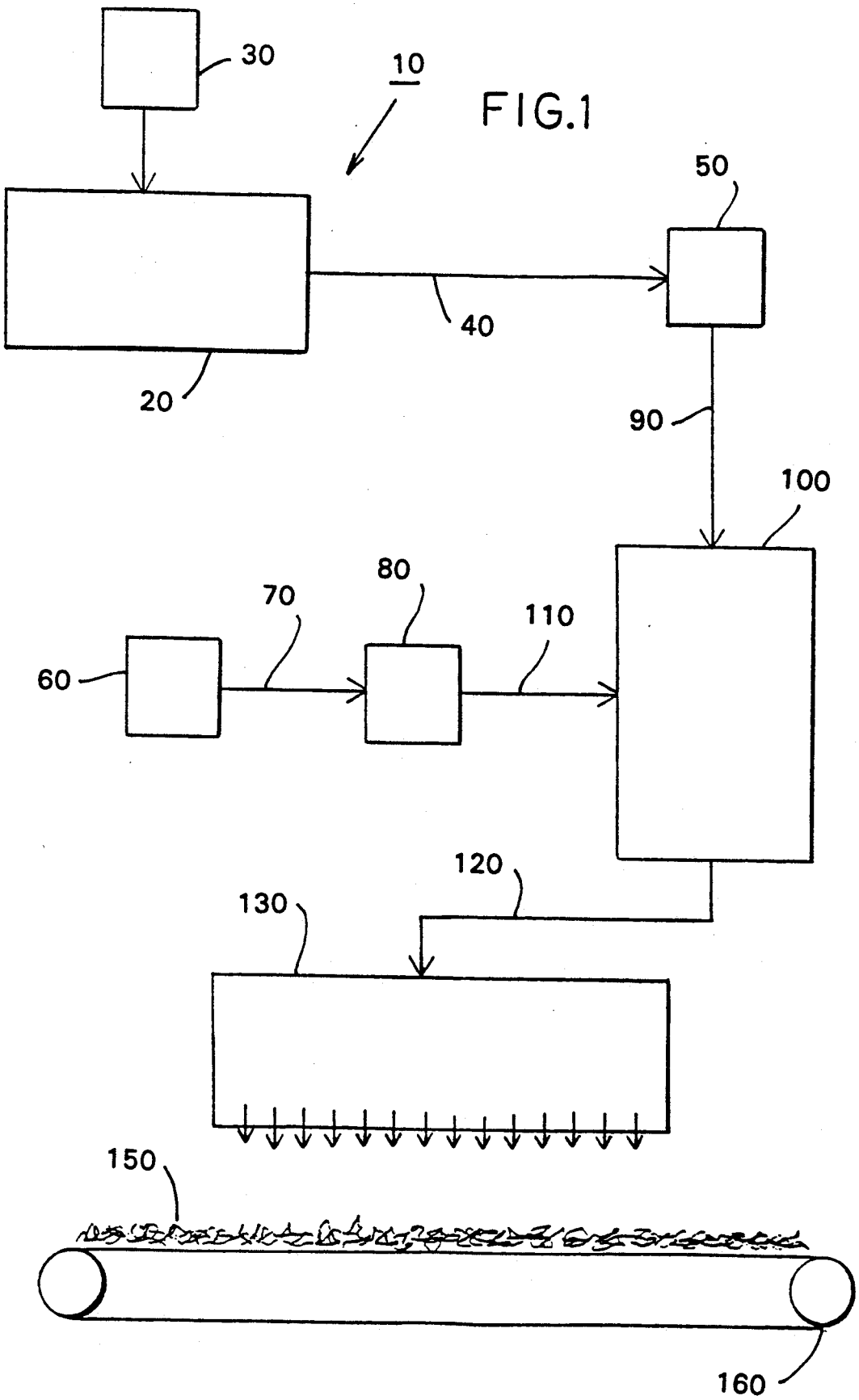
FIG. 1 is a flow diagram generally illustrating the method of the invention.

Chipboard in accordance with the invention is prepared by hot pressing a mass of wood chips, wood fibers or other lignocellulose material (herein referred to collectively as "wood material") and a binder. Any suitable wood material and binder may be employed, such as those taught by U.S. Pat. No. 4,110,397 to Wooer, the disclosure of which is herein incorporated by reference. In general, the wood material may be shavings, wood wool, cork, bark, sawdust and the like waste products from the woodworking industry, and/or fibers from other natural products which are lignocellulosic, for example, bagasse, straw, flax residues, and dried rushes, reeds and grasses. Nut shells, for example ground nuts, and hulls from cereal crops, for example rice and oats, are also included. Additives such as flakes and fibrous material (e.g., glass fiber, mica and asbestos) and synthetic products (e.g., rubbers and plastics) may also be included. Other wood material and additives will be apparent to one skilled in the art.

The binder may be any suitable binder, such as formaldehyde resins (usually urea-formaldehyde, melamine-formaldehyde or phenol-formaldehyde) or an isocyanate-based binding agent. The isocyanate-based binder is generally preferred in the field and may be any suitable organic polyisocyanate either alone or in admixture with another type of binder, for example, a synthetic resin glue. The binder may be liquid, such as a solution of the binder in an inert solvent or an aqueous emulsion. Other binders will be apparent to one skilled in the art.

The release agent may be any suitable release agent, such as silicone oil, lecithin, carnauba wax, polytetrafluoroethylene, metal salts of long chain aliphatic or cycloaliphatic acids, carboxy-functional siloxanes and vegetable oil soap surface active agents. The release agent is preferably capable of foam expansion to 30 to 300 times its original volume. Other release agents will be apparent to one skilled in the art.

The wood materials, binders and release agents are all conventional and are all discussed in the patents mentioned in the above "Background of the Invention" section. The disclosures of all those patents are herein incorporated by reference. A preferred wood material, binder and release agent are: aspen or pine shavings; isocyanate binder, such as MDI; and metal salts of long chain aliphatic acids, such as potassium oleate.

The aqueous solution generally contains about 0.1 to 20%, preferably about 1 to 10% release agent, and about 0.1 to 20%, preferably about 1 to 10% foaming agent. All percentages expressed herein are weight percentages, unless otherwise specified. The release agent and the foaming agent may be the same substance. If one substance is used for both the release agent and foaming agent, the aqueous solution generally contains 0.1% to 20%, preferably 1 to 10% of the combined release and foaming agent. A preferred aqueous release agent composition is an aqueous solution of a metal salt of a long chain aliphatic acid, such as 20% by weight potassium oleate, the potassium oleate also functioning as a foaming agent. Vegetable oil soap also functions as both a release agent and foaming agent in accordance with the invention. Paraffin wax is a suitable release agent, but is non-foaming such that a foaming agent such as sodium lauryl sulfate must be used. Other non-foaming release agents suitable for use in the invention include montan wax and sodium stearate. Preferably, a single chemical substance is used as both the foaming agent and release agent for economic reasons.

The foaming agent, if included in the aqueous solution, may be any suitable foaming agent, such as sodium laureth sulfate (sodium lauryl ether sulfate) or alkyl polyglycosides. Other foaming agents will be apparent to one skilled in the art.

Referring now to the drawings wherein like numbers describe like elements, there is shown in FIG. 1 a system (in flow diagram form) in accordance with the principles of the invention and designated generally as 10. The system 10 includes a pressure pot or tank 20 into which an aqueous solution of release agent and foaming agent is placed. A pump (not shown) may be utilized in place of pressure pot 20. Compressed air is supplied from compressed air source 30 to force solution through line 40 to metering device 50. At the same time, additional compressed air from compressed air source 60 flows through line 70 to metering device 80. Solution from metering device 50 flows through line 90 to a packed column 100 and compressed air flows through line 110 to the packed column 100. The packings (not shown) may be any suitable high surface area to volume solid such as porcelain saddles used in distillation processes. Both metered fluids enter column 100 where they are contacted and foam is generated. Preferably, the foam incorporates all the compressed air from compressed air source 60. The column may be 1" in diameter by 2" long to 24" in diameter by 8' long, depending upon the output of foam required. Foam formed in column 100 flows through line 120 to dispersion device 130. The foam formed in column 100 is a coherent, continuously uniform foam formed of fine bubbles generally less than about 1 mm. in diameter. The foam has a specific gravity of about 0.033 to about 0.0033.

The above-described foaming apparatus is commercially available from the Mearl Corporation, 220 West Westfield Avenue, Roselle Park, N.J. 07204. Release agent is available from Surfactants Corporation, 260 Ryan Street, South Plainfield, N.J. 07080. In addition to this foaming apparatus, dispersion device 130 is provided. This device is constructed for use in the invention in combination with the conventional foamer described above.

Figure 2:
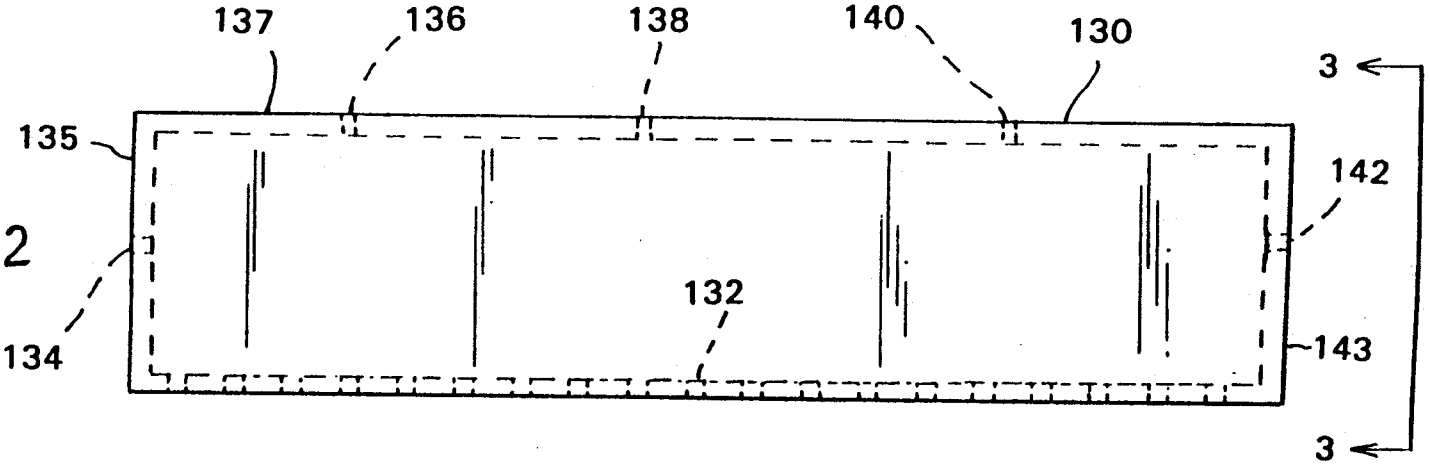
FIG. 2 shows a dispenser box element utilized to apply foamed release agent onto the mass of wood material and binder in accordance with the invention.
Figure 3:
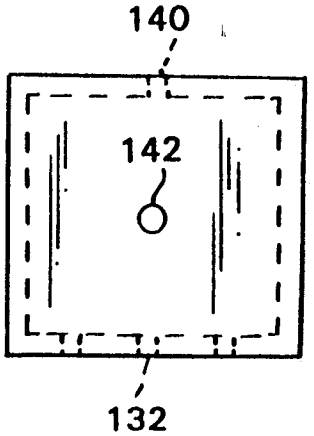
FIG. 3 is an end view of the dispenser box element taken along lines 3—3 in FIG. 2.

Referring now to FIGS. 2 and 3, dispersion device 130 is a box for receiving the foam from line 120 and dispersing it onto mass 150 of wood material and binder passing on a conveyor 160 positioned beneath dispersion device 130. Dispersion device 130 includes several rows of closely spaced (approximately ¼ inch apart from center to center) apertures 132 (shown in phantom in FIGS. 2 and 3), each aperture 132 having a diameter of about 1/16 inch. Foam from line 120 enters dispersion device 130 through apertures 134 and 142 located in side walls 135 and 143, respectively, of device 130 and apertures 136, 138 and 140 located in a top wall 137 of device 130. Foam is forced through apertures 132 into numerous individual streams that, soon after emerging from dispersion device 130, merge to form a single continuous foam blanket which deposits on mass 150. Subsequently, and not shown in the drawings, mass 150 is compressed in a platen or platens in a conventional manner to form the chipboard and then cut to any desired size to complete its manufacture.

During operation of system 10, the aqueous solution of release agent and foaming agent is pressurized in pressure pot 20 to a pressure of about 30 to about 200 psig, preferably about 60 to about 150 psig. The solution then flows through metering device 50 where the desired volume of solution is metered to flow through line 90 into packed column 100. At the same time, compressed air from compressed air source 60 is metered in metering device 80 so that the correct volume of air enters packed column 100. The pressure of these two fluid lines, solution and compressed air, are in the same range of about 30 to about 200 psig, preferably 60 to about 150 psig, and are generally about equal to each other. Solution and air temperature may range from about 32° F. to about 130° F., preferably 65° F. to about 90° F. The actual pressure used will depend on the volume of foam required. In general, the higher the pressure, the greater the foam volume. The foam flow rate will depend on the area and speed of the chipboard line. The foam flow rate may be between about 2 and about 200 $ft^3$/min, preferably between about 25 and about 100 $ft^3$/min. As foam emerges from packed column 100, its pressure is greatly reduced but is sufficient to enter the dispersion device 130 and apertures 132 located in the dispersion device 130. The pressure of the foam emerging from packed column 100 may vary from about 2 psi to about 50 psi, preferably from about 10 psi to about 40 psi, depending on the flow rate employed. The foam streams emerging from the apertures 132 fall by gravity and merge into a single blanket. This blanket falls on the moving bed of chips 150 and entirely covers the chips. The rate of foam production generally matches the volume of foam required to cover the chips as the belt moves.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for applying release agent to a mass of wood material and binder during production of chipboard, the release agent enhancing release of the mass from a platen after hot compression of the mass to form the chipboard, the method comprising the steps of:

(a) pressurizing an aqueous solution comprising a release agent and a foaming agent;

(b) metering a predetermined amount of the pressurized aqueous solution to a foamer;

(c) foaming the aqueous solution in the foamer to form a coherent, continuously uniform, finely bubbled foam; and (d) dispersing the foam formed in the foamer onto the mass.

2. The method of claim 1, wherein step (a) comprises metering a predetermined amount of compressed air to the aqueous solution.

3. The method of claim 1, wherein step (c) comprises metering a predetermined amount of compressed air to the foamer.

4. The method of claim 1, wherein step (d) comprises forming a continuous blanket of the foam on the mass.

5. The method of claim 4, wherein the continuous blanket is formed by dispersing individual streams of foam onto the mass and merging the individual streams to form the continuous blanket.

6. In a method for manufacturing chipboard including the steps of applying a release agent to a mass of wood material and binder, compressing the mass using a platen to form a substantially flat sheet of the mass and cutting the compressed mass to a predetermined shape, the improvement comprising the steps of:

(a) pressurizing an aqueous solution comprising a release agent and a foaming agent;

(b) metering a predetermined amount of the pressurized aqueous solution to a foamer;

(c) foaming the aqueous solution in the foamer to form a coherent, continuously uniform, finely bubbled foam; and (d) dispersing the foam formed in the foamer onto the mass.

7. The method of claim 6, wherein step (a) comprises metering a predetermined amount of compressed air to the aqueous solution.

8. The method of claim 6, wherein step (c) comprises metering a predetermined amount of compressed air to the foamer.

9. The method of claim 6, wherein step (d) comprises dispersing a continuous blanket of the foam on the mass.

10. The method of claim 9, wherein the continuous blanket is formed by dispersing individual streams of foam onto the mass and merging the individual streams to form the continuous blanket.

* * * * *